US006226830B1

(12) United States Patent
Hendriks et al.

(10) Patent No.: US 6,226,830 B1
(45) **Date of Patent: *May 8, 2001**

(54) VACUUM CLEANER WITH OBSTACLE AVOIDANCE

(75) Inventors: Antonius Hendriks, Veldhoven (NL); Damian M. Lyons, Putnam Valley; Frank Guida, Fishkill, both of NY (US)

(73) Assignee: Philips Electronics North America Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/917,001

(22) Filed: Aug. 20, 1997

(51) Int. Cl.[7] ..... A47L 5/00

(52) U.S. Cl. ..... 15/319; 15/325; 15/327.2; 15/340.2

(58) Field of Search ..... 15/319, 325, 377, 15/327.1, 327.2, 340.1, 340.2

(56) References Cited

U.S. PATENT DOCUMENTS

| | | | | |
|---|---|---|---|---|
| 4,654,924 | | 4/1987 | Getz et al. | 15/319 |
| 4,914,327 | | 4/1990 | Dekker | 307/632 |
| 4,953,253 | | 9/1990 | Fukuda et al. | 15/319 |
| 4,959,556 | | 9/1990 | Dekker et al. | 307/261 |
| 4,977,639 | * | 12/1990 | Takahashi et al. | 15/319 |
| 5,265,305 | | 11/1993 | Kraft et al. | 15/319 |
| 5,293,955 | | 3/1994 | Lee | 180/169 |
| 5,341,540 | * | 8/1994 | Soupert et al. | 15/319 |
| 5,353,468 | | 10/1994 | Yap et al. | 15/319 |
| 5,355,548 | | 10/1994 | Dekker | 150/319 |
| 5,568,589 | * | 10/1996 | Hwang | 15/319 X |

FOREIGN PATENT DOCUMENTS

| | | | |
|---|---|---|---|
| 0319700 | 6/1989 | (EP) . | |
| 0389459 | 9/1990 | (EP) . | |
| 0389459A3 | 9/1990 | (EP) | A47L/11/40 |
| 0420265B1 | 4/1991 | (EP) | A47L/5/36 |
| 0558101A2 | 9/1993 | (EP) | A47L/5/36 |
| 2-116335A | 5/1990 | (JP) | A47L/9/00 |

* cited by examiner

*Primary Examiner*—Elizabeth McKane
(74) *Attorney, Agent, or Firm*—Ernestine C. Bartlett

(57) ABSTRACT

A vacuum cleaner is provided that is adapted to detect and display and/or avoid obstacles. In such vacuum cleaners the driving wheels and/or castor wheels that determine the direction of travel may be actively controlled to achieve, at the point in time of obstacle touch or obstacle sensing, a resultant velocity away from obstacles in the path of the cleaning apparatus.

28 Claims, 4 Drawing Sheets

VACUUM CLEANER WITH OBSTACLE AVOIDANCE

FIELD OF THE INVENTION

This invention relates to an apparatus comprising an electric motor with a variable motor power, a control circuit for controlling the movement of the apparatus, and a vacuum chamber for generating a partial vacuum by means of the electric motor.

BACKGROUND OF THE INVENTION

Such an apparatus may be constructed, for example, as a vacuum cleaner comprising a vacuum cleaner body with a hose provided with a nozzle coupled to the air inlet of the vacuum cleaner body, which body comprises a dust chamber in communication with the air inlet and a housing for a fan driven by an electric motor, which housing is in communication with the dust chamber and the air outlet. Such vacuum cleaners may be of the type commonly referred to as upright or canister. The usual canister-type vacuum cleaners have bodies with front portions having blunt, rounded shapes which are normally pulled along by a hose during cleaning. This blunt body shape often gets blocked or snagged or rendered immobile behind furniture parts such as chair and table legs, for example, forcing the user to interrupt vacuum cleaning to free the vacuum cleaner before cleaning can be resumed.

Such an apparatus is known from EP 0 420 265 and its related patent EP 0 558 101 A2, which relate to such vacuum cleaners adapted to avoid obstacles on a cleaning surface to be cleaned even if the outer contour of the cleaner body is generally flat. The disclosed vacuum cleaners comprise an angularly movable traveling member angularly mounted on the cleaner body to be angularly movable around an outer wall of the dust collector chamber, or a swinging plate which constitutes part of the traveling member, has casters and is mounted by a shaft on a lower front surface so as to be angularly movable about the shaft. The angular member has a bumper that is first caused to collide with the obstacle. When the suction hose is pulled further, the bumper is angularly moved together with the angularly movable member to turn the cleaner body in a direction away from the obstacle and to move it to a position whereby the obstacle can be avoided. In a second embodiment, a swinging plate is movable right and left about a shaft portion and a spring member mounted on the swinging plate produces a spring force for angularly returning the swinging plate to its initial position when the swinging member is angularly moved. The swinging plate is held in a neutral position when the obstacle does not collide with the swinging plate. In addition to requiring numerous and intricate parts and the accompanying expense of manufacture, these vacuum cleaners do not utilize an actively controlled driving or direction control. The castor wheels, for example, are not actively controlled to achieve, at the point in time of obstacle touch or obstacle sensing, a resultant velocity away from the obstacle, and are not adapted to achieve this result when subjected to arbitrary forward velocities such as those that a user imposes by pulling the vacuum by the hose. Moreover, there is no detection of obstacles for avoidance and thus reduced wear and tear on the vacuum cleaners.

There is a need for a vacuum cleaner of the type described above which will embody the characteristics of:

(1) robust obstacle detection and display or robust obstacle detection and avoidance or robust obstacle detection, display, and avoidance and (2) non-contact or minimal contact sensing (3) simple electronics and mechanics (4) low cost (5) the ability to retrofit existing designs.

SUMMARY OF THE INVENTION

An object of the invention is to provide an apparatus such as a vacuum cleaner which will exhibit the characteristics listed above.

Another object of the invention is to provide a vacuum cleaner that is adapted to avoid obstacles on a surface to be cleaned even if the outer contour of the cleaner body is generally flat or blunt or rounded, and in which the drive direction is actively controlled.

Another object of the invention is to provide an apparatus such as a vacuum cleaner to detect and avoid obstacles and wherein the driving and/or direction-determining means is actively controlled to achieve, at the point in time of obstacle touch or obstacle sensing, a resultant velocity away from obstacles in the path of the cleaning apparatus.

Yet another object of the invention is to provide an apparatus such as a vacuum cleaner wherein the driving and/or direction-determining means is actively controlled to achieve, at the point in time of touch or obstacle sensing, a resultant velocity away from obstacles in the path of the cleaning apparatus and which is adapted to achieve this result when the cleaning apparatus is subjected to arbitrary forward velocities such as those that a user imposes by pulling the vacuum by the hose.

Another object is to provide an apparatus such as a vacuum cleaner wherein the distance of an obstacle is sensed and remotely displayed to the user to permit the user to "see" the obstacle even when the same is not visible, for example when it is hidden under furniture or the like. Optionally, the vacuum cleaner may otherwise be of conventional design, and the user may use the displayed information to manually avoid the obstacle, or this detect and display feature of the invention may be combined with an apparatus having an obstacle avoidance feature according to the invention and wherein the driving and/or direction-determining means is actively controlled to achieve, at the point in time of obstacle detection and/or touch and/or display, a resultant velocity away from the displayed and/or sensed and/or touched obstacle.

These and other objects are accomplished, according to the invention by the provision of a cleaning apparatus, for example, a vacuum cleaner which comprises:

a housing provided with an electric motor, an intake portion, a body portion, a controller comprising a signal processing unit (SPU), and display means associatively adapted to display an input from the SPU, wherein the body portion includes at least one touch or proximity sensor for detecting the presence of at least one obstacle in the proximity of the cleaning apparatus travel path and delivering an input to the SPU for display on said display means.

In a preferred embodiment, the cleaning apparatus also includes means for sensing the distance of an obstacle and remotely displaying information derived from said sensing, and in especially preferred embodiments, the means for sensing includes at least three sensors located as left, right, and middle sensors the input from which is respectively displayed and is indicative of the approximate distances from the cleaning apparatus to the obstacle detected by the respective sensor.

In another preferred embodiment of the invention, there is provided a cleaning apparatus having a housing provided with an electric motor, a body portion which comprises an intake hose, at least one direction-controlling means, for example at least one castor wheel, at least one driving means, for example at least one drive wheel, and means, for example, a controller comprising a signal processing unit (SPU), for controlling at least the direction of at least one of the direction-controlling means or driving means, wherein the means for controlling direction, for example the controller, also includes multiple sensors for detecting the presence of at least one obstacle in the proximity of the vacuum cleaner travel path and delivering information or input to the SPU, the controller being adapted to actuate a change in at least the direction of at least one of the direction-controlling means or driving means based on said sensor detection and information or input to move the vacuum cleaner to avoid the obstacle at the point in time of contact and/or sensing and to maintain an arbitrary, forward velocity.

For ease of description, the invention will be described in terms of a vacuum cleaner with castor wheel or castor wheels and drive wheel or wheels. It will be understood that the invention is not to be limited to such terms and any cleaning apparatus with suitable direction-controlling-means other than castor wheels and driving means other than driving wheels are included within the scope of the invention.

Thus, the invention provides a vacuum cleaner with a conventional motor and fan for vacuuming, a nozzle, dust chamber and dust filter, and a body with touch or proximity sensors with either display means or angular body portions and a direction controller or all of these features. In its simplest preferred embodiment, the novel vacuum cleaner of the invention includes angular, pointed vacuum cleaner body front portions at least one of which includes at least one and preferably two touch or proximity sensors. The sensors are mounted on an angular, pointed portion of the front of the vacuum cleaner or multiple sensors may be mounted in angular disposition relative to at least one other sensor to achieve virtual angularity. When an obstacle such as a table leg or chair is touched and/or sensed, the sensors signal the controller to effect a change in direction or velocity or in both the direction and velocity of either the castor wheel(s) or drive wheel(s) or all of the wheels of the vacuum cleaner to propel the vacuum cleaner away from or to otherwise take such action as is necessary to avoid the obstacle so that vacuuming may continue.

The invention provides a vacuum cleaner which combines simple sensors and control of the castor wheel and/or drive wheels with a body design or shape that at any forward velocity allows the vacuum cleaner to move away from the obstacle at the point in time of contact and/or sensing. The forward or front shape of the vacuum cleaner can be arbitrary as long as both the constraint of instantaneous motion direction at the point in time of contact with and/or sensing of an obstacle is towards the inside of the vacuum cleaner body and a forward velocity component can be maintained.

This may also be accomplished by actuation of movement towards the center of the vacuum cleaner. As a result, a velocity away from the obstacle will be initiated and the vacuum cleaner will move away from the obstacle. The pointed, angular design or virtual angularity design of the vacuum cleaner makes it possible to achieve this movement away from the obstacle at arbitrary forward velocities that the user may impose by pulling on the hose. This cannot be achieved with the blunt body shapes that are conventionally used. Thus, at the point in time of contact and/or sensing, the vacuum cleaner is adapted to generate motion directed away from the obstacle, i.e. motion towards the inner side of the vacuum body while maintaining a forward velocity component. This result may be achieved through the controller's control of the castor wheel or drive wheels or both. The controller may also direct direction of movement and turning of the wheels in any sequence or combination through motors connected to the wheels. Such control may also be obtained by, for example, using an electromagnet with three switches: neutral, left, and right. The controller may comprise electronic components well known in the art, for example a CPU card with microcontroller and sensors effective to perform measurements and programmable displacement of the castor and/or drive wheels.

The sensors may also be very simple and may be selected from various forms well known in the art such as infrared, ultrasonic, bumper(touch), etc. In each case, the appropriate signal is sent to the SPU component of the controller to effect the appropriate wheel action to avoid the sensed obstacle.

For example, two strips of metal with rubber cushioning may be embedded in a rubber protection band on each of two angular front portions or on the sides of the angular front portions of the vacuum cleaner and be configured to signal or provide input to the SPU when compressed to make contact. Alternatively, sensors may be arranged on the vacuum cleaner body so that furniture or an obstacle breaks the path of an electromagnetic radiation beam when movement of the vacuum is hindered by the obstacle. This may be achieved by, for example, mounting a light emitting diode (LED) and a photosensor on the vacuum cleaner so that the light path between the LED and the photosensor is broken by the obstacle.

In a preferred embodiment of the invention, photosensors are disposed on the vacuum cleaner body and LEDs are disposed on the hose at desired angles relative to each other.

In an especially preferred embodiment, the vacuum cleaner body may be of a shape that is not angular but which has at least two first sensors, preferably infrared lights placed at predetermined angles to second sensors, or an LED emitter, preferably included on the vacuum cleaner hose attachment or other part of the vacuum cleaner that is in a forward position relative to the sensors located on the vacuum cleaner body. Additionally, for example, when the vacuum cleaner has a swivel hose attachment, the second sensors may be attached in a forward position of the first sensors via a spring or extension that is free from interference with the swivel hose. In any case, however, the first and second sensors form a coherent light beam between them. When these sensors sense an obstacle as is the case when the beam between the first and second sensors is broken by an obstacle, they can signal the controller to control the castor wheel or control the drive wheels or control both the castor or drive wheels or first one and then the other to cause a change in direction. The motion controller may at this point turn or cause turning of the castor wheel away from the obstacle or the user may desire that actuation of turning occur at the point of minimal contact with the obstacle to permit vacuuming as close to the obstacle as is possible. This may be accomplished, for example, using a multi-position solenoid by which the castor will for example, spin freely when no voltage is applied or assume one of multiple positions, for example left, right, south, north, etc., when the appropriate field coil is energized.

We have found that a major problem with certain sensing means such as retroflective infrared sensing is the varying ability to detect objects of different size, shape, color, and texture. This is a particular problem in a living room environment, for example. A break-beam sensor configuration as used in this invention provides robust sensing of table and chair legs and corners, etc. and avoids this problem.

In another embodiment of the invention, the vacuum cleaner, which may be either an upright or canister style, is adapted for easier cleaning under furniture, for example, under beds, tables, etc., despite the occlusion of the cleaner head and without the user having to repeatedly bend over to look to assess the situation. This is accomplished via the use of at least one sensor, and preferably at least three sensors such as infrared or sonar sensors, located as, for example, a left, right, and or middle sensor. In this embodiment, information from the sensor is displayed to the user to allow the user to "see" what is close to the vacuum cleaner head, even if the head is obstructed from the user's view. Preferably, these sensors display to the user approximate distances from the vacuum cleaner head to an obstacle, and when used in conjunction with the obstacle avoidance system of this invention, provides for efficient vacuuming and avoidance of obstacles even when the user cannot see the obstacle. When used without the obstacle avoidance system, efficient vacuuming and manual avoidance of such unseen obstacles is provided. The sensor display may be mounted on the hand hold and may be used on both canister and upright model styles. The display can be as inexpensive as one or more LEDs. The intensity of each LED may be used to indicate the distance between the sensor corresponding with that LED and the nearest obstacle, the brighter the LED, the nearer the obstacle. The LEDs can be colored and positioned corresponding to their associated sensor. For example, a sensor on the left side of the hand hold may be green and correspond to a distance sensor on the left side of the cleaner head; a middle LED might be red and correspond to the middle sensor; and a right LED might be yellow and correspond to a right sensor on the cleaner head. In this way, it may be achieved that a user can vacuum under furniture without repeatedly bending over to see what is blocking the head or how well the floor is being cleaned. A benefit of this arrangement is there is less wear and tear on the vacuum cleaner head as a result of its being hit against unseen obstacles. As indicated above, this embodiment of the invention may or may not include the obstacle avoidance feature of the invention.

DETAILED DESCRIPTION OF THE PREFERRED EMBODIMENTS

Figure 1A:
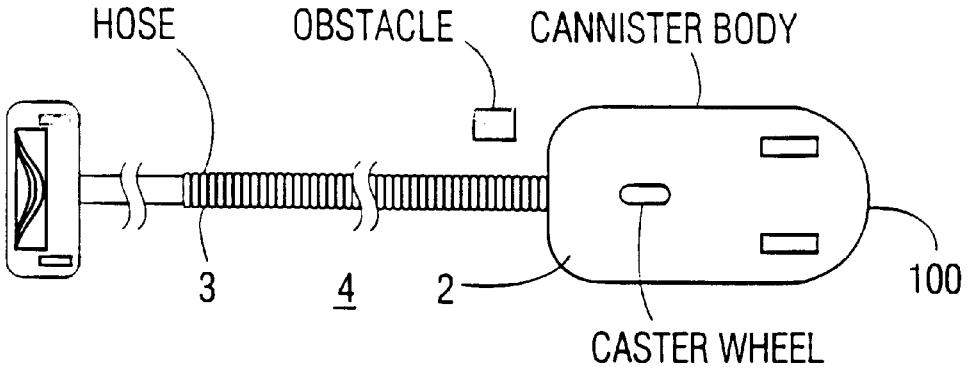
FIG. 1A PRIOR ART
FIG. 1*a* is a diagrammatic illustration of a vacuum cleaner of the prior art.

With reference to FIG. 1*a*, there is illustrated a conventional canister-type vacuum cleaner 1 with a rounded-rectangular body portion 2 having a hose 3 attached thereto and an obstacle in the travel path. While the vacuum cleaner is being pulled by the hose by the user, this blunt body frequently snags behind the obstacle requiring the user to free it for further vacuuming activity.

Figure 1B:
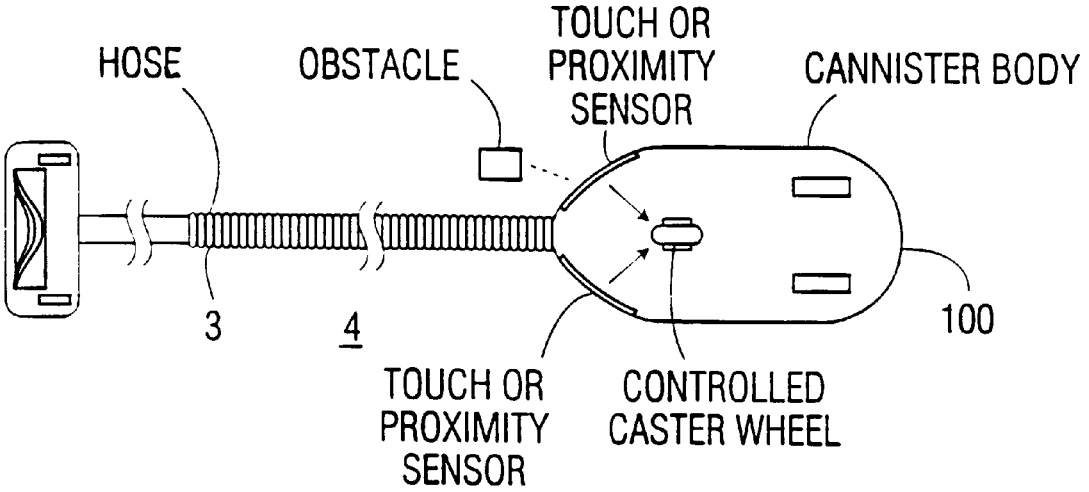
FIG. 1*b* is a diagrammatic illustrations of a vacuum cleaner with an obstacle avoidance system according to the invention.
Figure 2A:
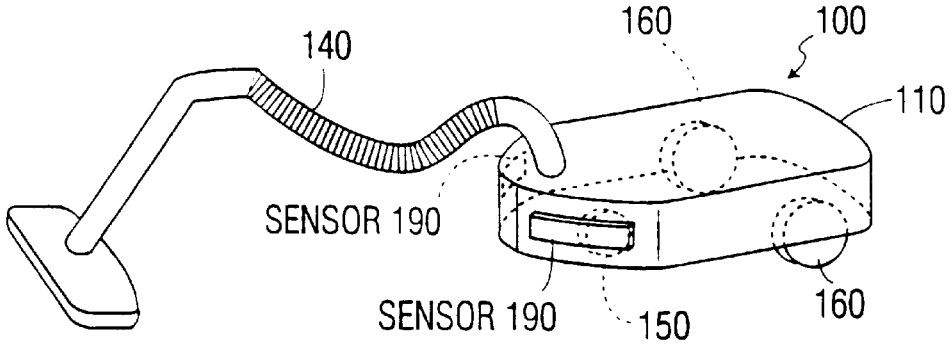
FIGS. 2*a* and 2*b* are diagrammatic illustrations of a vacuum cleaner with angular body portions and sensors according to one embodiment of the invention.
Figure 2B:
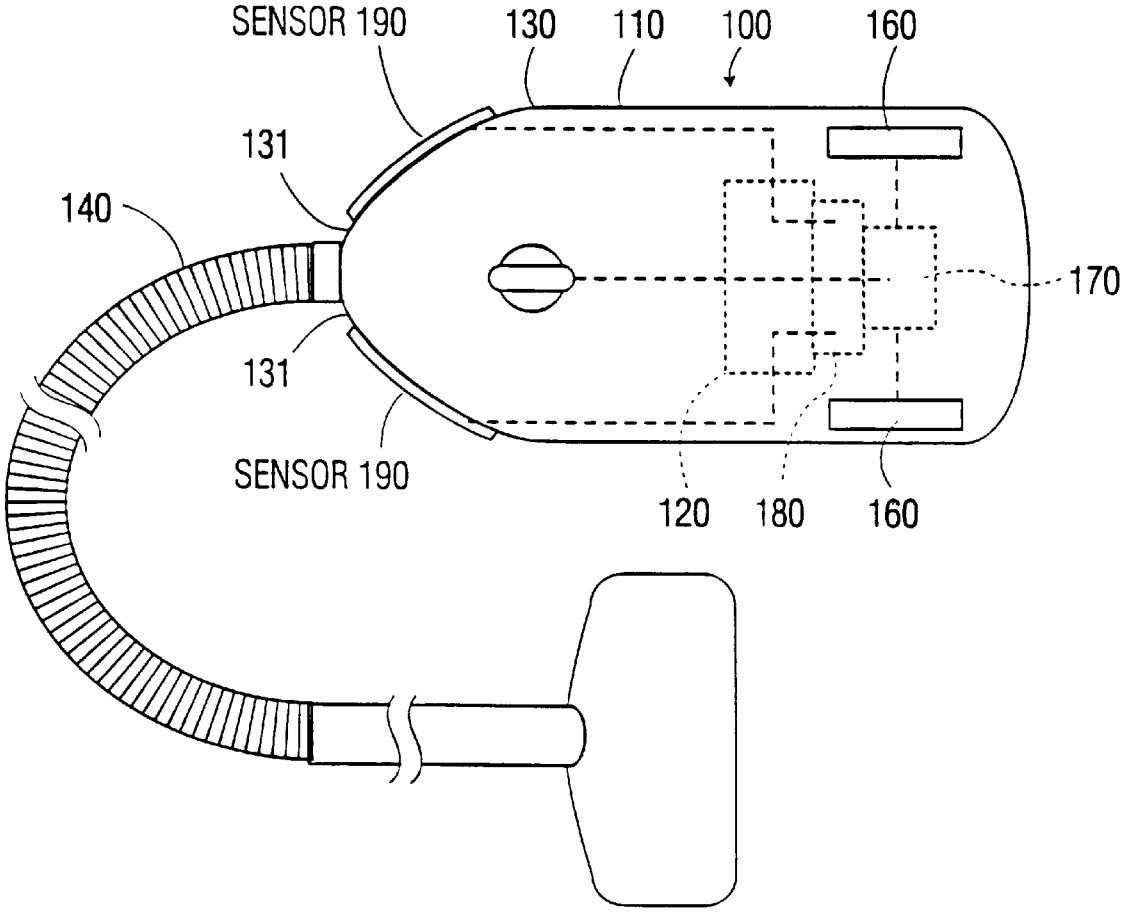

With reference to FIG. 1*b*, there is illustrated a vacuum cleaner 100 that is adapted to detect and avoid an obstacle O on a surface 4 to be cleaned even if the outer contour of the cleaner body 130 is generally flat or blunt or rounded, and in which the drive direction is actively controlled to achieve, at the point in time of touch or obstacle sensing, a resultant velocity away from obstacles in the path of the cleaning apparatus. As illustrated in FIGS. 1*b* to 5, the vacuum cleaner 100 has a housing 110 provided with an electric motor 120, a body portion 130 which comprises an intake hose 140, a castor wheel 150, two drive wheels 160, and a controller 170 comprising a signal processing unit (SPU) 180 for controlling at least the direction of at least one of the drive wheels 160. The body portion 130 includes angular, pointed vacuum cleaner body front portions 131 at least one of which includes at least one touch or proximity sensor 190. The sensors 190 are mounted on the angular, pointed portions 131 of the front of the vacuum cleaner 100. The sensors 190 are two strips of metal with rubber cushioning embedded in a rubber protection band on each of two angular front portions 131 and are associatively adapted to generate predetermined signals to provide input to the SPU when compressed to make contact.

Figure 3:
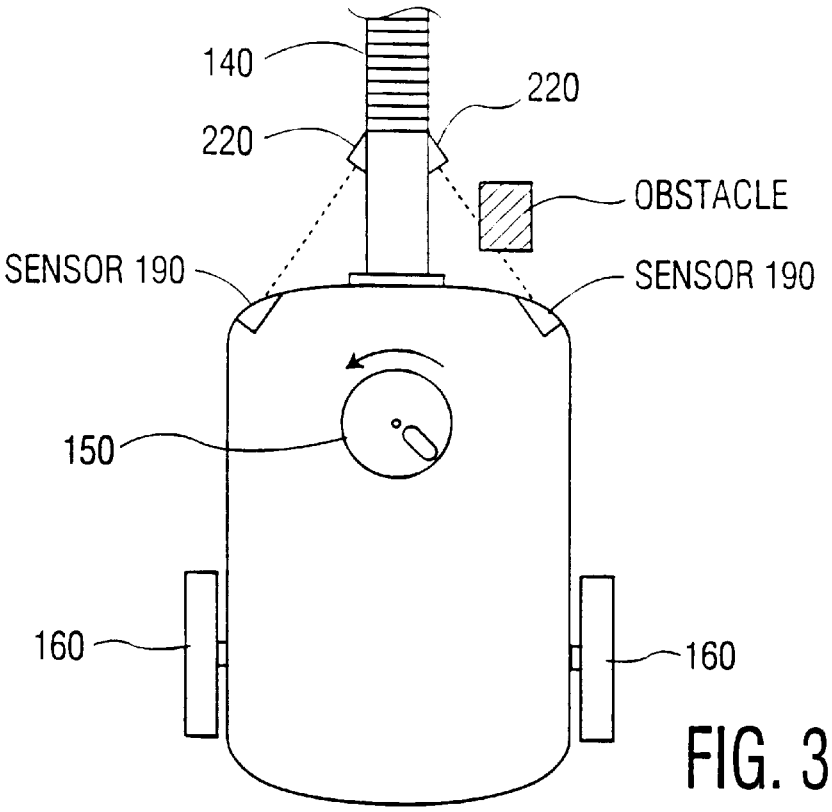
FIG. 3 is a diagrammatic illustration of a vacuum cleaner with virtual angularity and sensors according to an embodiment of the invention.
Figure 4:
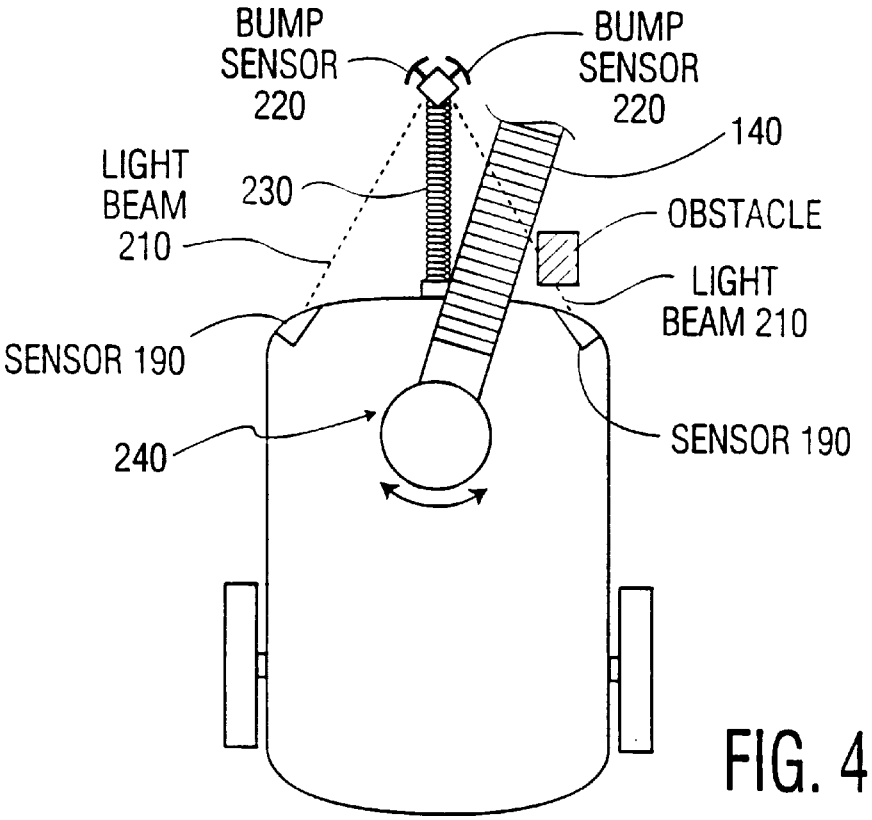
FIG. 4 is a diagrammatic illustration of an alternative embodiment of a vacuum cleaner with virtual angularity.

As illustrated in the embodiments of FIGS. 3 and 4, multiple sensors 190 are mounted in angular disposition relative to at least one other sensor 220 to achieve virtual angularity. Such sensors 190 are arranged on the vacuum cleaner body 130 so that when movement of the vacuum is hindered by an obstacle, the obstacle breaks the path of an electromagnetic radiation beam 210 between a light emitting diode (LED) 220 and a photosensor 190 on the vacuum cleaner. In a preferred embodiment illustrated in FIG. 3, the photosensors 190 are disposed on the vacuum cleaner body 130 and the LEDs 220 are disposed on the hose 140 at the desired angles relative to each other that are necessary to accomplish the virtual angularity. In this way, a vacuum cleaner body of any shape may be given the required angularity by virtual angularity, i.e. by the placement of at least two first sensors 190, preferably infrared lights, at predetermined angles to second sensors 220, preferably LED emitters, preferably included on the vacuum cleaner hose attachment or other part of the vacuum cleaner that is in a forward position relative to the sensors 190 located on the vacuum cleaner body 130.

In the embodiment illustrated in FIG. 4, when the vacuum cleaner has a swivel hose attachment 240, the second sensors 220 may be attached in a forward position of the first sensors 190 via a spring or extension 230 that is free from interference with the swivel hose 240. In any case, however, the first and second sensors form a coherent light beam 210 between them. When these sensors sense an obstacle as is the case when the beam between the first and second sensors is broken, they effectively signal the controller to control the castor wheel or control the drive wheels or control both the castor or drive wheels or first one and then the other to cause a change in direction.

In any of the various embodiments, the motion controller 170, upon receipt of a signal from the sensor 190 that indicates detection of the obstacle, will at this point actuate movement of the castor wheel 150 away from the obstacle or the user may desire that actuation occur at the point of minimal contact with the obstacle to permit vacuuming as close to the obstacle as is possible.

The controller 170 includes at least one sensor 190 for detecting the presence of at least one obstacle in the proximity of the vacuum cleaner travel path and delivering input to the SPU 180, the controller being adapted to actuate a change in at least the direction of at least one castor wheel 150 as illustrated by the arrows in FIG. 1*b*, i.e. towards the center of the vacuum cleaner, or by actuating the drive wheels 160 based on said detection and input to move the vacuum cleaner to avoid the obstacle at the point of contact or sensing and to maintain an arbitrary, forward velocity. The sensors signal the controller to effect a change in direction or velocity or both the direction and velocity of either the castor wheel(s) or drive wheel(s) or all of the wheels of the vacuum cleaner to propel the vacuum cleaner away from or to otherwise take such action as is necessary to avoid the obstacle.

Figure 5:
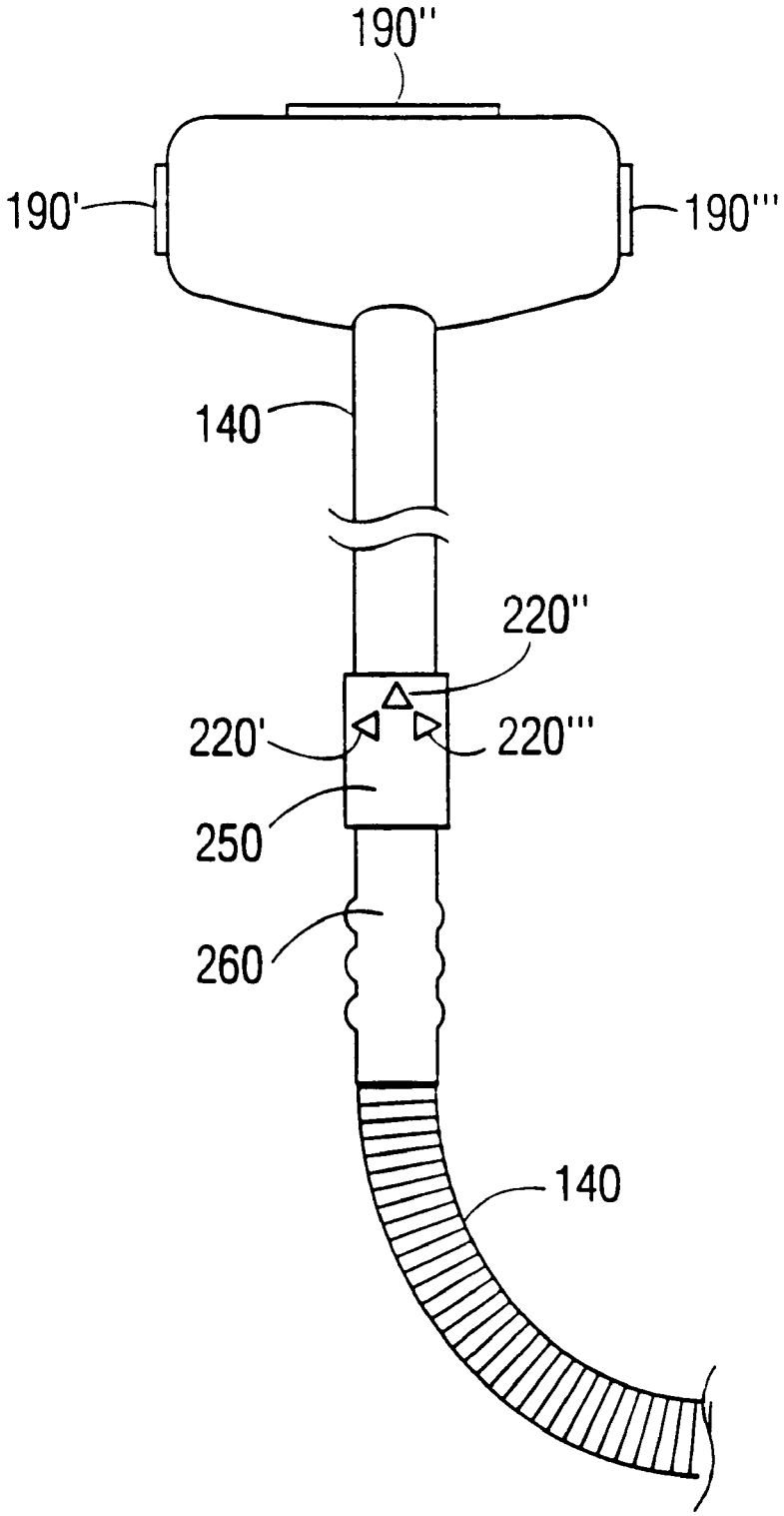
FIG. 5 is a diagrammatic illustration of a vacuum cleaner with a distance sensing display according to an embodiment of the invention.

In the embodiment illustrated in FIG. 5, a vacuum cleaner, wit or without obstacle avoidance, may also include a system wherein the distance of an obstacle is sensed and remotely displayed to the user. In such a vacuum cleaner, the driving or direction-determining means may be actively controlled by the controller, or the vacuum cleaner may be manually turned or pulled, to achieve, at the point of touch or obstacle sensing, a resultant velocity away from the sensed obstacle. The vacuum cleaner 100, which may be either an upright or canister style, includes multiple sensors 190, preferably at least three infrared or sonar sensors located as left, right, and middle sensor, 190', 190", and 190'". In this embodiment, information from the sensor is displayed to the user in a display 250 on the hand hold 260 to allow the user to "see" what is close to the vacuum cleaner head, even if the head is obstructed from the user's view. Preferably, these sensors display to the user approximate distances from the vacuum cleaner head to an obstacle, and when used in conjunction with the obstacle avoidance system of this invention, provides for efficient vacuuming and avoidance of obstacles even when the user cannot see the obstacle. The display consists of, for example, multiple LEDs 220', 220", and 220'", the intensity of each LED being used to indicate the distance between the sensor corresponding with that LED and the nearest obstacle, the brighter the LED, the nearer the obstacle. The LEDs can be colored and positioned corresponding to their associated sensor. For example, a sensor 190' on the left side of the hand hold 260 may be green and correspond to a distance sensor 220' on the left side of the cleaner head 145; a middle LED 190" might be red and correspond to the middle sensor 220"; and a right LED 190'" might be yellow and correspond to a right sensor 220'" on the cleaner head. In this way, it may be achieved that a user can vacuum under furniture without repeatedly bending over to see what is blocking the head or how well the floor is being cleaned.

It will be seen from the preceding description that the invention provides a simple, robust, and low cost system, suitable for retrofit of older designs, of detecting and remotely displaying an obstacle in the travel path, and of avoiding an obstacle in the vacuum cleaner path by detecting the obstacle and actuating movement of the vacuum cleaner of the canister or upright type away from an obstacle such as furniture, and facilitates the avoidance of the vacuum cleaner being snagged or blocked by obstacles such as furniture. The invention may be embodied in other specific forms without departing from the spirit and scope or essential characteristics thereof, the present disclosed examples being only preferred embodiments thereof.

We claim:

1. A cleaning apparatus which comprises:

a housing provided with an electric motor, a body portion which comprises an intake portion, a hose portion attached to the body portion and adapted to permit a user to move the cleaning apparatus by user movement of said hose portion at least one direction-controlling means comprising one or more castor wheels which controls the direction of the forward motion of said apparatus in response to a controller, and a controller comprising a signal processing unit (SPU) for controlling at least the direction of the at least one castor wheel, wherein the body portion includes angular front portions at least one of which includes at least one touch or proximity sensor for detecting the presence of at least one obstacle in the proximity of a travel path of the cleaning apparatus and delivering an input to the SPU, the controller being adapted to actively control at least the direction of at least one castor wheel to actuate a change in at least the direction of the at least one castor wheel based on said detection and input, said controller being effective, based solely on input from said sensor, to cause the cleaning apparatus to move in the correct direction to avoid the obstacle when the user pulls the hose portion at the point in time of contact or sensing.

2. A cleaning apparatus as claimed in claim 1 wherein the controller actively controls the movement of the driving or direction-determining means to achieve, at the point in time of touch or obstacle sensing, a resultant velocity away from an obstacle in the path of the cleaning apparatus.

3. A vacuum cleaner which comprises:

a housing provided with an electric motor, a body portion which comprises an intake hose portion adapted to permit a user to move the cleaning apparatus by user movement of said hose portion, at least one direction-controlling means comprising one or more castor wheels which controls the direction of the forward motion of said apparatus in response to a controller, at least one driving means, and a controller comprising a signal processing unit (SPU) for controlling at least the direction of the at least one castor wheel, wherein the body portion includes multiple touch and proximity sensors mounted in angular disposition relative to at least one other sensor to achieve virtual angularity of the body portion for detecting the presence of at least one obstacle in the proximity of a vacuum cleaner travel path and delivering an input to the SPU, the controller being adapted to actuate a change in at least the direction of the at least one castor wheel based on said detection and input to cause the vacuum cleaner to move in the correct direction to avoid the obstacle when the user pulls the hose portion at the point in time of contact or sensing.

4. A vacuum cleaner as claimed in claim 3, wherein said sensors signal the controller to effect a change in direction or velocity or both the direction and velocity of either the at least one direction-controlling means or driving means or both the driving means and direction-controlling means to move the vacuum cleaner to avoid the obstacle.

5. A vacuum cleaner as claimed in claim 4, wherein said sensors are two strips of metal with rubber cushioning embedded in a rubber protection band on each of two angular front portions of said body which provide an input to the SPU when the band is compressed.

6. A vacuum cleaner as claimed in claim 4, wherein said sensors are arranged on the vacuum cleaner body so that the obstacle when detected or touched breaks the path of an electromagnetic radiation beam.

7. A cleaning apparatus which comprises:

a housing provided with an electric motor, a body portion which comprises an intake portion, at least one direction-controlling means comprising at least one castor wheel which controls the direction of the forward motion of said apparatus in response to a controller, at least one driving means, and a controller comprising a signal processing unit (SPU) for controlling at least the direction of the at least one castor wheel and driving means, wherein the body portion includes angular front portions at least one of which includes at least one touch or proximity sensor for detecting the presence of at least one obstacle in the proximity of a travel path of the cleaning apparatus and delivering an input to the SPU, the controller being adapted to actuate a change in at least the direction of the at least one castor wheel based on said detection and input to cause the cleaning apparatus to move in the correct direction toward the center of the vacuum cleaner body to avoid the obstacle when the user pulls the hose portion at the point in time of contact or sensing, said controller actively controlling the movement of the castor wheel toward the center of the vacuum cleaner body to achieve, at the point in time of touch or obstacle sensing, a resultant velocity away from the obstacle in the path of the cleaning apparatus, which resultant velocity is achieved when the cleaning apparatus is subjected to arbitrary forward velocities that a user imposes by pulling the apparatus by an intake hose.

8. A cleaning apparatus which comprises:

a housing provided with an electric motor, a body portion which comprises an intake portion, a hose portion connectable to said body portion, at least one direction-controlling means, at least one driving means, and a controller comprising a signal processing unit (SPU) for controlling at least the direction of the at least one direction-controlling means or driving means, wherein the body portion includes angular front portions at least one of which includes at least one touch or proximity sensor in the form of an electromagnetic radiation beam generated by mounting a light emitting diode (LED) and a photosensor on the vacuum cleaner for detecting the presence of at least one obstacle in the proximity of a travel path of the cleaning apparatus and delivering an input to the SPU, the controller being adapted to actuate a change in at least the direction of at least one of the direction-controlling means or driving means based on said detection and input to move the cleaning apparatus to avoid the obstacle at the point in time of contact or sensing.

9. A vacuum cleaner as claimed in claim 8, wherein the photosensor is disposed on the vacuum cleaner body and the LED is disposed on the hose at desired angles relative one to the other.

10. A vacuum cleaner as claimed in claim 9, wherein the first and second sensors are arranged on the vacuum cleaner body so that the obstacle when detected and/or touched breaks the path of an electromagnetic radiation beam.

11. A vacuum cleaner as claimed in claim 10, wherein upon breaking of the path of said electromagnetic radiation beam by an obstacle, said sensors provide input to the controller to actuate the direction-controlling means or the drive means or any combination thereof to move the vacuum cleaner to avoid the obstacle.

12. A vacuum cleaner as claimed in claim 11, wherein said actuation occurs at the point in time of minimal contact of the vacuum cleaner with the obstacle.

13. A vacuum cleaner as claimed in claim 10, wherein said actuation occurs at the moment of sensing the obstacle.

14. A vacuum cleaner which comprises:

a housing provided with an electric motor, a body portion which comprises an intake hose, at least one direction-controlling means, at least one driving means, and a controller comprising a signal processing unit (SPU) for controlling at least the direction of the at least one direction-controlling means or driving means, wherein the body portion includes at least two infrared sensors mounted in angular disposition relative to at least two LED emitter sensors located on a hose attachment to achieve virtual angularity of the body portion for detecting the presence of at least one obstacle in the proximity of a vacuum cleaner travel path and delivering an input to the SPU, the controller being adapted to actuate a change in at least the direction of at least one of the direction-controlling means or driving means based on said detection and input to move the vacuum cleaner to avoid the obstacle at the point of contact or sensing.

15. A vacuum cleaner as claimed in claim 14, which includes a swivel hose attachment and the second sensors are attached in a position that is forward of the first sensors.

16. A vacuum cleaner as claimed in claim 15, wherein the second sensors are attached to a spring that extends from the vacuum cleaner body and is free from interference with the swivel hose.

17. A vacuum cleaner which comprises:

a housing provided with an electric motor, a body portion which comprises an intake hose, at least one direction-controlling means, at least one driving means, and a controller comprising a signal processing unit (SPU) for controlling at least the direction of the at least one direction-controlling means or driving means, wherein the body portion includes multiple touch and proximity sensors mounted in angular disposition relative to at least one other sensor to achieve virtual angularity of the body portion for detecting the presence of at least one obstacle in the proximity of a vacuum cleaner travel path and delivering an input to the SPU, and wherein the vacuum cleaner further comprises a display means for displaying information relative to the distance of the detected obstacle, said means including at least three sensors associatively operative with said SPU and at least three corresponding display indicia, the controller being adapted to actuate a change in at least the direction of at least one of the direction-controlling means or driving means based on said detection and input to move the vacuum cleaner to avoid the obstacle at the point of contact or sensing.

18. A vacuum cleaner as claimed in claim 17, wherein said display indicia are LEDs associatively adapted to cooperate with said sensors and mounted on a hand held portion of a hose attachment.

19. A vacuum cleaner as claimed in claim 18, wherein the intensity of each LED is used to indicate the distance between the sensor associated with the respective LED and the obstacle detected by the sensor.

20. A cleaning apparatus which comprises:

a housing provided with an electric motor, an intake portion, a body portion, a hose portion attached to the body portion and adapted to permit a user to move the cleaning apparatus by user movement of said hose portion, a controller comprising a signal processing unit (SPU), and display means associatively adapted to display an input from the SPU, wherein the body portion includes at least one touch or proximity sensor for detecting the presence of at least one obstacle in the proximity of the cleaning apparatus travel path and delivering an input to the SPU for display on said display means, and wherein said apparatus also includes means for sensing the distance of an obstacle and remotely displaying information derived from said sensing.

21. A cleaning apparatus as claimed in claim 20, which includes at least three sensors located as left, right, and middle sensors the input from which is respectively displayed and is indicative of the approximate distances from the cleaning apparatus to the obstacle detected by the respective sensor.

22. A cleaning apparatus which comprises:

a housing provided with an electric motor, a body portion which comprises an intake portion, a hose portion attached to the body portion and adapted to permit a user to move the cleaning apparatus by user movement of said hose portion, at least one direction-controlling means, at least one driving means, and a controller comprising a signal processing unit (SPU) for controlling at least the direction of the at least one direction-controlling means or driving means, wherein the body portion includes angular front portions at least one of which includes at least one touch or proximity sensor for detecting the presence of at least one obstacle in the proximity of a travel path of the cleaning apparatus and delivering an input to the SPU, and wherein said apparatus also includes means for sensing the distance of an obstacle and remotely displaying information derived from said sensing, the controller being adapted to actuate a change in at least the direction of at least one of the direction-controlling means or driving means based on said detection and input to move the cleaning apparatus to avoid the obstacle at the point in time of contact or sensing.

23. A vacuum cleaner which comprises:

a housing provided with an electric motor, a body portion which comprises an intake hose portion adapted to permit a user to move the cleaning apparatus by user movement of said hose portion, at least one direction-controlling means, at least one driving means, and a controller comprising a signal processing unit (SPU) for controlling at least the direction of the at least one direction-controlling means or driving means, wherein the body portion includes at least two first sensors mounted in angular disposition relative to at least two second sensors, said first sensors being disposed at predetermined angles to said second sensors to achieve virtual angularity of the body portion for detecting the presence of at least one obstacle in the proximity of a vacuum cleaner travel path and delivering an input to the SPU, the controller being adapted to actuate a change in at least the direction of at least one of the direction-controlling means or driving means based on said detection and input to move the vacuum cleaner to avoid the obstacle at the point of contact or sensing.

24. A vacuum cleaner as claimed in claim 23, wherein said first sensors are infrared lights and said second sensors are LED emitters.

25. A vacuum cleaner as claimed in claim 24, wherein said first sensors are located on said body portion.

26. A vacuum cleaner which comprises:

a housing provided with an electric motor, a body portion which comprises an intake hose portion adapted to permit a user to move the cleaning apparatus by user movement of said hose portion, at least one direction-controlling means, at least one driving means, and a controller comprising a signal processing unit (SPU) for controlling at least the direction of the at least one direction-controlling means or driving means, wherein the body portion includes multiple touch and proximity sensors mounted in angular disposition relative to at least one other sensor to achieve virtual angularity of the body portion for detecting the presence of at least one obstacle in the proximity of a vacuum cleaner travel path and delivering an input to the SPU, the controller being adapted to actuate a change in at least the direction of at least one of the direction-controlling means or driving means based on said detection and input to move the vacuum cleaner to avoid the obstacle at the point of contact or sensing, and wherein the vacuum cleaner further comprises a display means for displaying information indicative of the distance of the detected obstacle from said vacuum cleaner travel path, said means including sensors associatively operative with said SPU and corresponding display indicia based on input from said sensors.

27. A cleaning apparatus which comprises:

a housing provided with an electric motor, a body portion which comprises an intake portion, a hose portion attached to the body portion and adapted to permit a user to move the cleaning apparatus by user movement of said hose portion, at least one direction-controlling means which controls the direction of the forward motion of said apparatus in response to a controller, and a controller comprising a signal processing unit (SPU) for controlling at least the direction of the at least one direction-controlling means, wherein the body portion includes angular front portions at least one of which includes at least one touch or proximity sensor for detecting the presence of at least one obstacle in the proximity of a travel path of the cleaning apparatus and delivering an input to the SPU, the controller being adapted to actively control at least the direction of at least one castor wheel to actuate movement of the direction-controlling means towards the inside of the vacuum cleaner body to maintain an arbitrary forward velocity based on said detection and input, said controller being effective, based solely on the input from said sensor, to cause the cleaning apparatus to move in the correct direction to avoid the obstacle when the user pulls the hose portion at the point in time of contact with or sensing of an obstacle.

28. A cleaning apparatus which comprises:

a housing provided with an electric motor, a body portion which comprises an intake portion, a hose portion attached to the body portion and adapted to permit a user to move the cleaning apparatus by user movement of said hose portion, at least one direction-controlling means comprising one or more castor wheels which controls the direction of the forward motion of said apparatus in response to a controller, drive means comprising at least one drive wheel, and a controller comprising a signal processing unit (SPU) for controlling at least the direction of the at least one castor wheel, wherein the body portion includes angular front portions at least one of which includes at least one touch or proximity sensor for detecting the presence of at least one obstacle in the proximity of a travel path of the cleaning apparatus and delivering an input to the SPU, the controller being adapted to actuate a change in at least the direction of the at least one castor wheel based on said detection and input to cause the cleaning apparatus to move in the correct direction to avoid the obstacle when the user pulls the hose portion at the point in time of contact or sensing.

* * * * *